US011721878B2

(12) United States Patent
Tamiazzo

(10) Patent No.: US 11,721,878 B2
(45) **Date of Patent: *Aug. 8, 2023**

(54) FILTERS HAVING RESONATORS WITH NEGATIVE COUPLING

(71) Applicant: CommScope Italy S.r.l., Agrate Brianza (IT)

(72) Inventor: Stefano Tamiazzo, Milan (IT)

(73) Assignee: CommScope Italy S.r.l., Agrate Brianza (IT)

( * ) Notice: Subject to any disclaimer, the term of this patent is extended or adjusted under 35 U.S.C. 154(b) by 75 days.

This patent is subject to a terminal disclaimer.

(21) Appl. No.: 17/515,697

(22) Filed: Nov. 1, 2021

(65) Prior Publication Data

US 2022/0059914 A1 Feb. 24, 2022

Related U.S. Application Data

(63) Continuation of application No. 16/683,573, filed on Nov. 14, 2019, now Pat. No. 11,223,094.

(60) Provisional application No. 62/796,809, filed on Jan. 25, 2019, provisional application No. 62/779,687, filed on Dec. 14, 2018.

(51) Int. Cl.

| | |
|---|---|
| ***H01P 1/205*** | (2006.01) |
| ***H01P 1/213*** | (2006.01) |
| ***H01P 7/04*** | (2006.01) |
| ***H01P 7/06*** | (2006.01) |

(52) U.S. Cl.

CPC ..... *H01P 1/205* (2013.01); *H01P 1/213* (2013.01); *H01P 1/2133* (2013.01); *H01P 7/04* (2013.01); *H01P 7/065* (2013.01)

(58) Field of Classification Search

CPC ..... H01P 1/205; H01P 1/213; H01P 1/2133; H01P 7/04; H01P 7/065; H01P 11/007

USPC ..... 333/219, 222, 223, 227, 230, 231, 232

See application file for complete search history.

(56) References Cited

U.S. PATENT DOCUMENTS

| | | | |
|---|---|---|---|
| 3,104,362 | A | 9/1963 | Matthaei |
| 5,225,799 | A | 7/1993 | West et al. |
| 5,343,176 | A | 8/1994 | Hasler |
| 5,812,036 | A | 9/1998 | Estrada |
| 6,249,195 | B1 | 6/2001 | Mikami et al. |
| 9,467,116 | B2 | 10/2016 | Subedi |

(Continued)

FOREIGN PATENT DOCUMENTS

| | | | |
|---|---|---|---|
| CN | 2703333 | Y | 6/2005 |
| CN | 201008016 | Y | 1/2008 |

(Continued)

OTHER PUBLICATIONS

Chinese Office Action corresponding to Chinese Application No. 201911278405.0 (20 pages) (dated Jan. 6, 2021).

(Continued)

*Primary Examiner* — Rakesh B Patel
*Assistant Examiner* — Jorge L Salazar, Jr.
(74) *Attorney, Agent, or Firm* — Myers Bigel, P.A.

(57) ABSTRACT

Filter devices are provided herein. A filter device includes a plurality of low-band resonators and a plurality of high-band resonators. In some embodiments, adjacent ones of the plurality of high-band resonators are spaced farther apart from each other than adjacent ones of the plurality of low-band resonators are spaced apart from each other.

16 Claims, 9 Drawing Sheets

(56) References Cited

U.S. PATENT DOCUMENTS

| | | | | |
|---|---|---|---|---|
| 11,223,094 | B2 * | 1/2022 | Tamiazzo | H01P 7/04 |
| 2013/0285765 | A1 | 10/2013 | Purna | |
| 2017/0263992 | A1 | 9/2017 | Nita et al. | |
| 2017/0346148 | A1 | 11/2017 | Tamiazzo et al. | |
| 2022/0181759 | A1 * | 6/2022 | Li | H01P 1/2053 |

FOREIGN PATENT DOCUMENTS

| | | | |
|---|---|---|---|
| CN | 105428763 | A | 3/2016 |
| CN | 106549201 | A | 3/2017 |
| CN | 107210505 | A | 9/2017 |
| EP | 0938153 | A1 | 8/1999 |
| EP | 1406342 | A1 | 4/2004 |
| WO | 2013027057 | A1 | 2/2013 |

OTHER PUBLICATIONS

European Search Report corresponding to European Application No. 19215262.7 (11 pages) (dated Apr. 21, 2020).

European Office Action corresponding to European Application No. 19215262.7 (9 pages) (dated Nov. 23, 2021).

Menzel et al. "Quasi-Lumped Suspended Stripline Filters and Diplexers" IEEE Transactions on Microwave Theory and Techniques 53(10):3230-3237 (Oct. 2005).

Chinese Office Action corresponding to Chinese Patent Application No. 202111558242.9 (Foreign Text, 10 Pages, English Translation Thereof, 9 Pages) (dated Nov. 29, 2022).

* cited by examiner

FILTERS HAVING RESONATORS WITH NEGATIVE COUPLING

CROSS-REFERENCE TO RELATED APPLICATIONS

The present application is a continuation of U.S. patent application Ser. No. 16/683,573, filed Nov. 14, 2019, which claims priority to U.S. Provisional Patent Application No. 62/779,687, filed Dec. 14, 2018, and to U.S. Provisional Patent Application No. 62/796,809, filed Jan. 25, 2019, the entire content of each of which is incorporated herein by reference.

FIELD

The present disclosure relates to communication systems and, in particular, to Radio Frequency (RF) filters.

BACKGROUND

One type of filter for RF applications is a resonator filter comprising a group of coaxial resonators. The overall transfer function of the resonator filter is a function of the responses of the individual resonators as well as the electromagnetic coupling between different pairs of resonators within the group.

U.S. Pat. No. 5,812,036 ("the '036 patent"), the entire disclosure of which is incorporated herein by reference, discloses different resonator filters having different configurations and topologies of resonators. FIG. 1A of the present specification corresponds to FIG. 3 of the '036 patent, which depicts a top sectional view of a six-stage resonator filter 200 having a 2-by-3 array of cavities between input terminal 204 and output terminal 206, where each cavity has a respective resonator (among resonators R1-R6) therein.

The resonator filter 200 has five coupling holes H1-H5 in walls defining the cavities between five sequential pairs of the resonators R1-R6 that enable main couplings between the sequential pairs. In addition, the resonator filter 200 has a first bypass coupling aperture $A_{C1}$ that enables cross-coupling between the non-sequential pair of resonators R2 and R5 in a direction Y. The resonator filter 200 also has a second bypass coupling aperture $A_{C2}$ that enables cross-coupling between the non-sequential pair of resonators R1 and R6. The main couplings between the five sequential pairs of resonators and the cross-couplings between the two non-sequential pairs of resonators contribute to the overall transfer function of the resonator filter 200.

The resonator filter 200 also includes a conductive housing 208, which defines a portion of the outer conductors of each of the resonators R1-R6. The remainder of each resonator outer conductor is formed by interior common walls W1, W2, W3, which also define the coupling holes H1-H5 through which sequential ones of the resonators R1-R6 are coupled to each other. The resonators R1-R6 may comprise, for example, either air-filled cavity resonators or dielectric-loaded coaxial resonators.

FIG. 1B of the present specification, which corresponds to FIG. 4 of U.S. Patent Pub. No. 2017/0346148 ("the '148 publication"), depicts a side sectional view of an in-line resonator filter 400 that has five inner conductors 410(1)-410(5). The entire disclosure of the '148 publication is incorporated herein by reference. Each of the inner conductors 410(1)-410(5) has (1) a high-impedance base 412 that is shorted to a bottom ground plane 402 and (2) a low-impedance, shaped head 414 that does not contact a top ground plane 404. The resonator filter 400 also has a lateral ground plane 406. Moreover, the inner conductors 410 may function as stepped impedance resonators (SIRs).

The five inner conductors 410(1)-410(5) of the in-line resonator filter 400 are linearly arranged to form a one-dimensional array of conductors. The inner conductors 410 can be, but do not have to be, perfectly aligned. One or more of the inner conductors 410 may be displaced toward the front or back of the resonator filter 400 (i.e., into or out of the page of FIG. 1B). No intervening walls may be between adjacent inner conductors 410 in the resonator filter 400, thus enabling more-substantial cross-coupling to occur between pairs of non-adjacent inner conductors 410.

Each inner conductor 410 in the resonator filter 400 has a corresponding tuning element 420. The resonator filter 400 also has four additional tuning elements 422(1)-422(4) located between corresponding adjacent inner conductors 410, where additional tuning elements 422(1) and 422(2) extend from the top ground plane 404, while additional tuning elements 422(3) and 422(4) extend from the bottom ground plane 402.

As shown in FIG. 1B, the resonator filter 400 has four conductive connectors 418(1)-418(4), each providing a physical (i.e., ohmic) connection between a different one of the four pairs of adjacent inner conductors 410.

Some of the heads 414 of the inner conductors 410 of the resonator filter 400 have different shapes, and the inter-conductor spacing between the inner conductors 410 varies from adjacent pair to adjacent pair. In FIG. 1B, heads 414(1) and 414(5) may be either cup-shaped or fork-shaped, while heads 414(2)-414(4) are fork-shaped. Also, the height of the inter-conductor connectors 418 varies from adjacent pair to adjacent pair. The resonator filter 400 is asymmetric along its lateral dimension, in that a 180-degree rotation about, for example, the vertical axis of base 412(3) of inner conductor 410(3) results in a view that is different from the view of the resonator filter 400 shown in FIG. 1B. All of these different and varying features of the resonator filter 400 contribute to its overall filter transfer function. The features can therefore be specifically designed to achieve a desired filter transfer function.

In general, based on the particular design of the resonator filter 400, both inductive and capacitive main coupling are present between each of the four pairs of adjacent inner conductors 410, where, for each pair, the sign of the capacitive main coupling is the opposite of the sign of the inductive main coupling, such that the capacitive and inductive main couplings compensate for one another to at least some degree. In addition, the resonator filter 400 has been designed such that non-negligible (e.g., inductive) cross-coupling is between certain pairs of non-adjacent inner conductors 410, where that non-negligible cross-coupling is achieved without employing discrete bypass connectors that ohmically connect non-adjacent inner conductors 410, whether those bypass connectors are internal or external to the resonator filter 400. For example, non-negligible cross-coupling may be present between inner conductor 410(1) and inner conductor 410(3). In addition, smaller, but still non-negligible cross-coupling may be present between inner conductors 410(1) and 410(4) or even between inner conductors 410(1) and 410(5). In general, the greater the separation distance between two inner conductors, the smaller the coupling strength.

Two basic coupling mechanisms can take place, both contributing to the amount of coupling between adjacent and non-adjacent inner conductors: capacitive coupling and inductive coupling.

Capacitive coupling can be controlled by adjusting the length and/or the impedance of the capacitive head 414 of each inner conductor 410 (e.g., by independently adjusting the dimensions A, B, and C of inner conductor 410(3)). This kind of interaction will contribute with a negative amount of capacitive coupling for adjacent pairs of inner conductors 410 and a positive amount of capacitive coupling for non-adjacent pairs of inner conductors.

Inductive coupling can be controlled by adjusting the lengths D and/or the heights E of the inter-conductor connections 418 connecting the different pairs of adjacent inner conductors, where the distance and height may vary from connection to connection. This kind of interaction will contribute with a positive amount of inductive coupling for both adjacent and non-adjacent pairs of inner conductors 410.

The capacitive and inductive contributions of the main couplings (i.e., between adjacent conductors) and the cross-couplings (i.e., between non-adjacent conductors) can be designed to meet prescribed coupling values, at least within a certain range of prescribed coupling values. The sign of the cross-couplings is always positive for the structure considered, while the sign of the main couplings can be conveniently set according to the specific blend of capacitive and inductive couplings. It is then possible to realize networks of coupled resonators and mixed signed couplings.

Depending on the number and location of the input/output (I/O) ports coupled to suitably selected inner conductors, different types of in-line resonator filters can be implemented. In-line resonator filters, such as in-line resonator filter 400 of FIG. 1B, can be represented by Halma topologies that indicate the non-negligible main and cross-couplings between adjacent and non-adjacent conductors.

SUMMARY

A filter device, according to some embodiments herein, may include a plurality of low-band resonators. Moreover, the filter device may include a plurality of high-band resonators having only negative couplings with each other.

In some embodiments, the filter device may include a single machined or die-cast piece that includes the plurality of high-band resonators. A first resonator head of a first of the plurality of high-band resonators may be opposite a second resonator head of a second of the plurality of high-band resonators, such that the first and second resonator heads are capacitively coupled to each other. The single machined or die-cast piece may include the plurality of low-band resonators and a housing from which the plurality of high-band resonators and the plurality of low-band resonators extend. Moreover, a shortest distance between the first and second resonator heads may be at least 4-6 millimeters (mm).

According to some embodiments, the filter device may include a substrate, and a first resonator layer of the filter device may include the plurality of high-band resonators and/or the plurality of low-band resonators on a first side of the substrate. Moreover, a second resonator layer of the filter device may be on an opposite, second side of the substrate. Like the first resonator layer, the second resonator layer may comprise a high-band and/or low-band resonator layer. The second resonator layer may be electrically coupled to the first resonator layer by one or more metallized vias extending from the first side of the substrate to the second side of the substrate. Additionally or alternatively, the second resonator layer may be electrically coupled to the first resonator layer by metal plating extending from the first side of the substrate to the second side of the substrate. For example, the metal plating may be on a sidewall of the substrate in an opening of the substrate that is between adjacent ones of the plurality of high-band resonators or between adjacent ones of the plurality of low-band resonators. Accordingly, the filter device may have a double-sided resonator structure.

A filter device, according to some embodiments herein, may include a plurality of low-band resonators. Moreover, the filter device may include a plurality of high-band resonators. A first resonator head of a first of the plurality of high-band resonators may be opposite a second resonator head of a second of the plurality of high-band resonators, such that the first and second resonator heads are capacitively coupled to each other.

In some embodiments, a shortest distance between the first and second resonator heads may be at least 4-6 millimeters (mm). Additionally or alternatively, at least one of the first resonator head or the second resonator head may include a cutout region. For example, the filter device may include a tuning element in the cutout region.

According to some embodiments, a third resonator head of a third of the plurality of high-band resonators may be opposite the first resonator head, such that the first and third resonator heads are capacitively coupled to each other. A stalk of the third of the plurality of high-band resonators may be shorter than a stalk of the first of the plurality of high-band resonators and shorter than a stalk of the second of the plurality of high-band resonators. Moreover, a fourth resonator head of a fourth of the plurality of high-band resonators may be opposite the third resonator head, such that the fourth and third resonator heads are capacitively coupled to each other. The fourth resonator head may be opposite a fifth resonator head of a fifth of the plurality of high-band resonators, such that the fourth and fifth resonator heads are capacitively coupled to each other. The third resonator head may be between the second and fifth resonator heads.

In some embodiments, the filter device may include a tuning element on a stalk of the first of the plurality of high-band resonators. Additionally or alternatively, the filter device may include a metal housing. The metal housing, the plurality of low-band resonators, and the plurality of high-band resonators together may have a monolithic metal structure.

According to some embodiments, a planar surface of the first of the plurality of high-band resonators may be coplanar with a planar surface of a first of the plurality of low-band resonators. The planar surface of the first of the plurality of high-band resonators may have a uniform thickness of at least 5 millimeters (mm). Additionally or alternatively, the first of the plurality of high-band resonators may be shorter than the first of the plurality of low-band resonators.

In some embodiments, adjacent ones of the plurality of high-band resonators may be spaced apart from each other by a first distance that is wider than a second distance by which adjacent ones of the plurality of low-band resonators are spaced apart from each other. Additionally or alternatively, the filter device may include a Radio Frequency (RF) combiner that includes the plurality of low-band resonators and the plurality of high-band resonators.

A filter device, according to some embodiments herein, may include a plurality of low-band resonators. The filter device may include a plurality of high-band resonators. Adjacent resonator heads of the plurality of high-band resonators may be spaced farther apart from each other than adjacent resonator heads of the plurality of low-band resonators are spaced apart from each other. Moreover, adjacent stalks of the plurality of high-band resonators may be spaced farther apart from each other than adjacent stalks of the plurality of low-band resonators are spaced apart from each other.

In some embodiments, the plurality of high-band resonators may include a plurality of planar Y-shaped resonators, respectively. Additionally or alternatively, the adjacent resonator heads of the plurality of low-band resonators may include planar rectangular resonator heads, respectively.

According to some embodiments, electromagnetic couplings between at least three of the plurality of high-band resonators may be only negative couplings. The at least three of the plurality of high-band resonators may include at least two pairs of opposed ones of the plurality of high-band resonators. Additionally or alternatively, positive coupling between the adjacent stalks of an even number of the plurality of high-band resonators may be smaller than the negative couplings.

A diplexer filter device, according to some embodiments herein, may include a low-band filter having only in-line resonators. Moreover, the diplexer filter device may include a high-band filter having opposed resonators.

In some embodiments, the opposed resonators may include two sets of oppositely-facing in-line resonators. A first resonator of a first set among the two sets may be oppositely-faced with a second resonator of the first set that is in line with a third resonator of a second set among the two sets. Moreover, the third resonator may be oppositely-faced with a fourth resonator of the second set that is in line with the first resonator. Electromagnetic couplings between the first set and the second set may be only negative couplings.

According to some embodiments, the diplexer filter device may include a single metal piece that includes both the low-band filter and the high-band filter. Additionally or alternatively, adjacent ones of the opposed resonators may be spaced apart from each other by a first distance that is wider than a second distance by which adjacent ones of the only in-line resonators are spaced apart from each other.

A filter device, according to some embodiments herein, may include a low-band filter. The filter device may include a high-band filter that includes in-line high-band resonators. The in-line high-band resonators may be in a single line in a first direction. Moreover, a first of the in-line high-band resonators may include a portion that extends in the first direction over a portion of a second of the in-line high-band resonators, such that the portion of the first of the in-line high-band resonators overlaps, and is capacitively coupled to, the portion of the second of the in-line high-band resonators in a second direction that is perpendicular to the first direction.

In some embodiments, the in-line high-band resonators may be the only high-band resonators of the high-band filter, and the low-band filter may include only in-line low-band resonators. Additionally or alternatively, the first of the in-line high-band resonators may be an L-shaped resonator, and the second of the in-line high-band resonators may be a T-shaped resonator or a Y-shaped resonator. Moreover, the filter device may include a tuning element between the first and the second of the in-line high-band resonators.

According to some embodiments, the portion of the second of the in-line high-band resonators may be a first portion, and a third of the in-line high-band resonators may include a portion that extends in the first direction over a second portion of the second of the in-line high-band resonators, such that the portion of the third of the in-line high-band resonators overlaps, and is capacitively coupled to, the second portion of the second of the in-line high-band resonators in the second direction. Moreover, the filter device may include a tuning element between the first and the third of the in-line high-band resonators.

A filter device, according to some embodiments herein, may include a low-band filter, a high-band filter, and a first ohmic connection that is between the low-band filter and the high-band filter and that electrically couples the low-band filter and the high-band filter to a common port of the filter device. The low-band filter may include interdigitating low-band resonators. A first and a second of the low-band resonators may be electrically coupled to each other by a second ohmic connection.

In some embodiments, the high-band filter may include a first high-band resonator that is opposite, and capacitively coupled to, a second high-band resonator of the high-band filter. Moreover, the high-band filter may include a third high-band resonator that is opposite, and capacitively coupled to, the first high-band resonator. The second and third high-band resonators may be in line with each other.

DETAILED DESCRIPTION

Pursuant to embodiments of the present inventive concepts, filter devices, such as RF combiners that include resonator filters, are provided. The high-band channel of RF combiners typically includes filters with a stopband located below the passband. To efficiently realize this, transmission zeros at frequencies below the passband may be introduced.

Conventional approaches to providing a stopband below the passband may include using cross-couplings and/or rejection cavities. Both of these approaches, however, may result in an increased number of mechanical parts, which, in turn, can cause one or more of the following: higher cost, higher assembly time, higher insertion loss, larger dimensions, and the like.

Figure 1A:
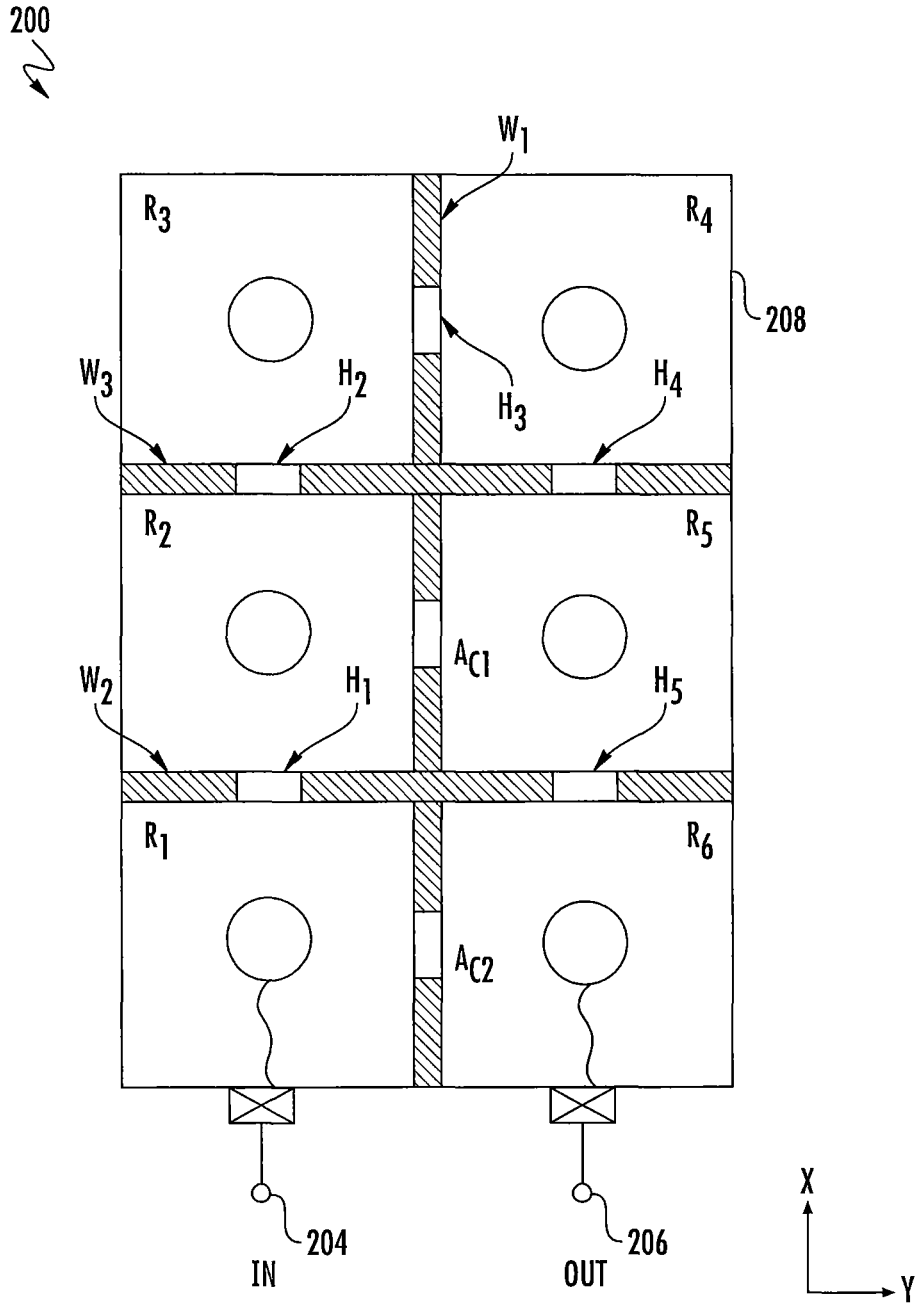
FIG. 1A PRIOR ART
FIG. 1A is a top sectional view of a six-stage resonator filter having a 2-by-3 array of coaxial resonators according to the prior art.
Figure 1B:
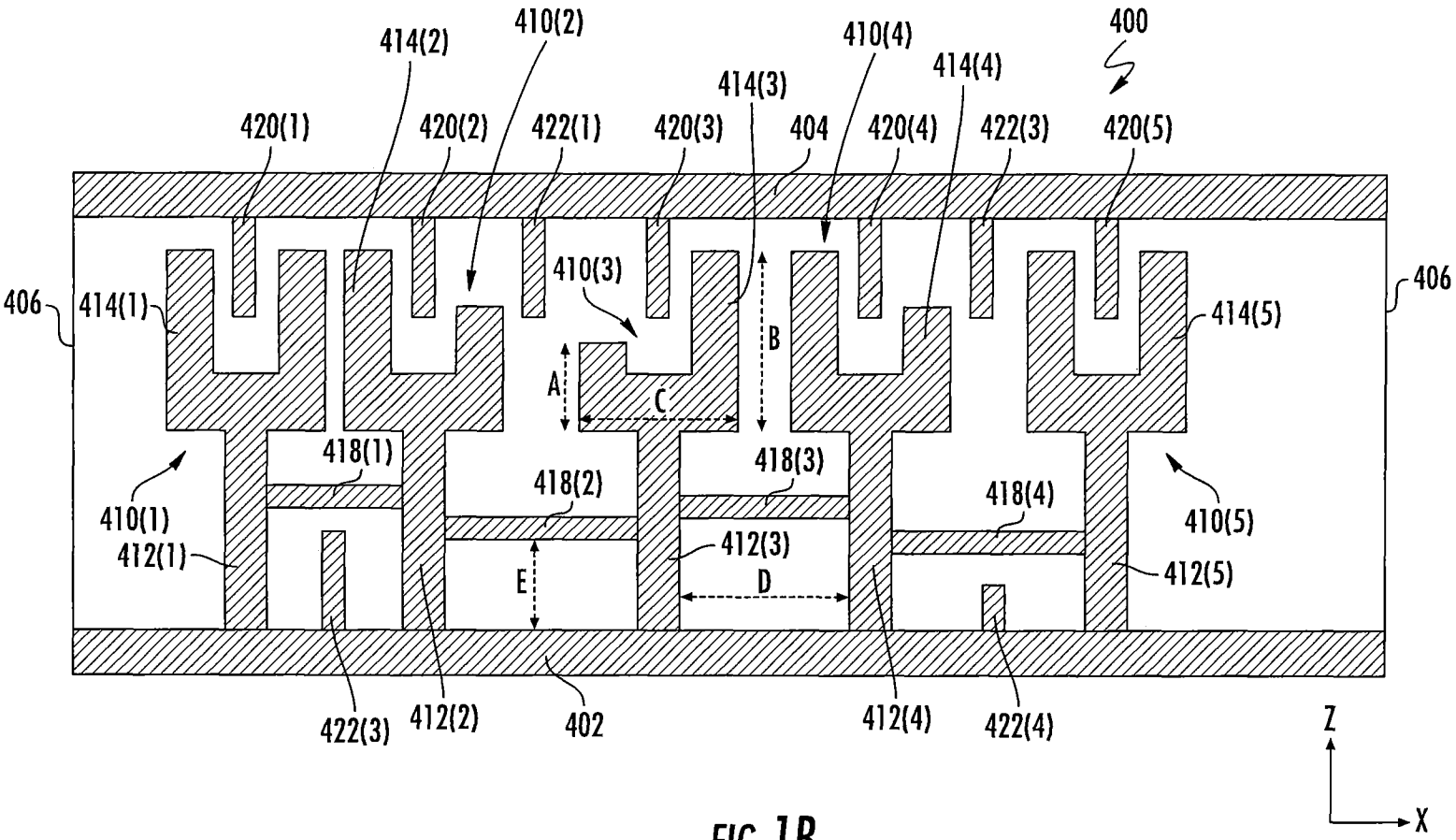
FIG. 1B PRIOR ART
FIG. 1B is a side sectional view of an in-line resonator filter according to the prior art.

Another conventional approach exploits mixed coupling (i.e., both positive and negative couplings) between adjacent coaxial resonators, together with positive spurious coupling between non-adjacent coaxial resonators, to provide transmission zeros below the passband of a high-band filter. The coupling between the resonators can be adjusted to provide the transmission zeros. A disadvantage of this approach is the relatively small distance (e.g., 3 mm or smaller) that may be required between open (capacitive coupling) ends of adjacent resonators to achieve mixed sign coupling between both adjacent and non-adjacent resonator pairs. For example, this approach may require very high coupling, and very small distances, between adjacent resonators relative to coupling between non-adjacent resonators. This can make the filter response sensitive to mechanical tolerances beyond the tuning capabilities of coupling screws. As an example, referring to FIG. 1B, though it may be desirable to place a tuning element between the head 414(1) and the head 414(2), the head 414(1) and the head 414(2) may lack sufficient space therebetween for a tuning element that is capable of tuning the resonators.

According to embodiments of the present inventive concepts, however, an approach suitable for high frequencies may involve arranging the shape and location of resonators in such a way that only (or almost only) negative couplings are used throughout a high-band channel filter. This can achieve a desirable/optimal high-band channel response with an acceptable compromise between size, mechanical complexity, stopband rejection, and insertion losses. Also, because the smallest distance between open ends of high-band resonators may, in some embodiments, be greater than 4 mm, the high-band channel filter can be more robust against mechanical tolerances.

By using only negative couplings, a good high-band channel filter can be provided. The use of exclusively-negative couplings can be achieved based on the shape and topology of the high-band resonators. For example, the high-band resonators may not all be arranged in a line, and thus may not provide an in-line high-band channel filter. Rather, the high-band resonators may be arranged and shaped to provide capacitive couplings between adjacent and non-adjacent ones of the high-band resonators, without providing inductive coupling(s) between the high-band resonators. As used herein, the term "adjacent ones" refers to a pair of resonators that does not have another resonator therebetween. The term "non-adjacent ones," by contrast, refers to a pair of resonators that has another resonator therebetween.

Example embodiments of the present inventive concepts will be described in greater detail with reference to the attached figures.

Figure 1C:
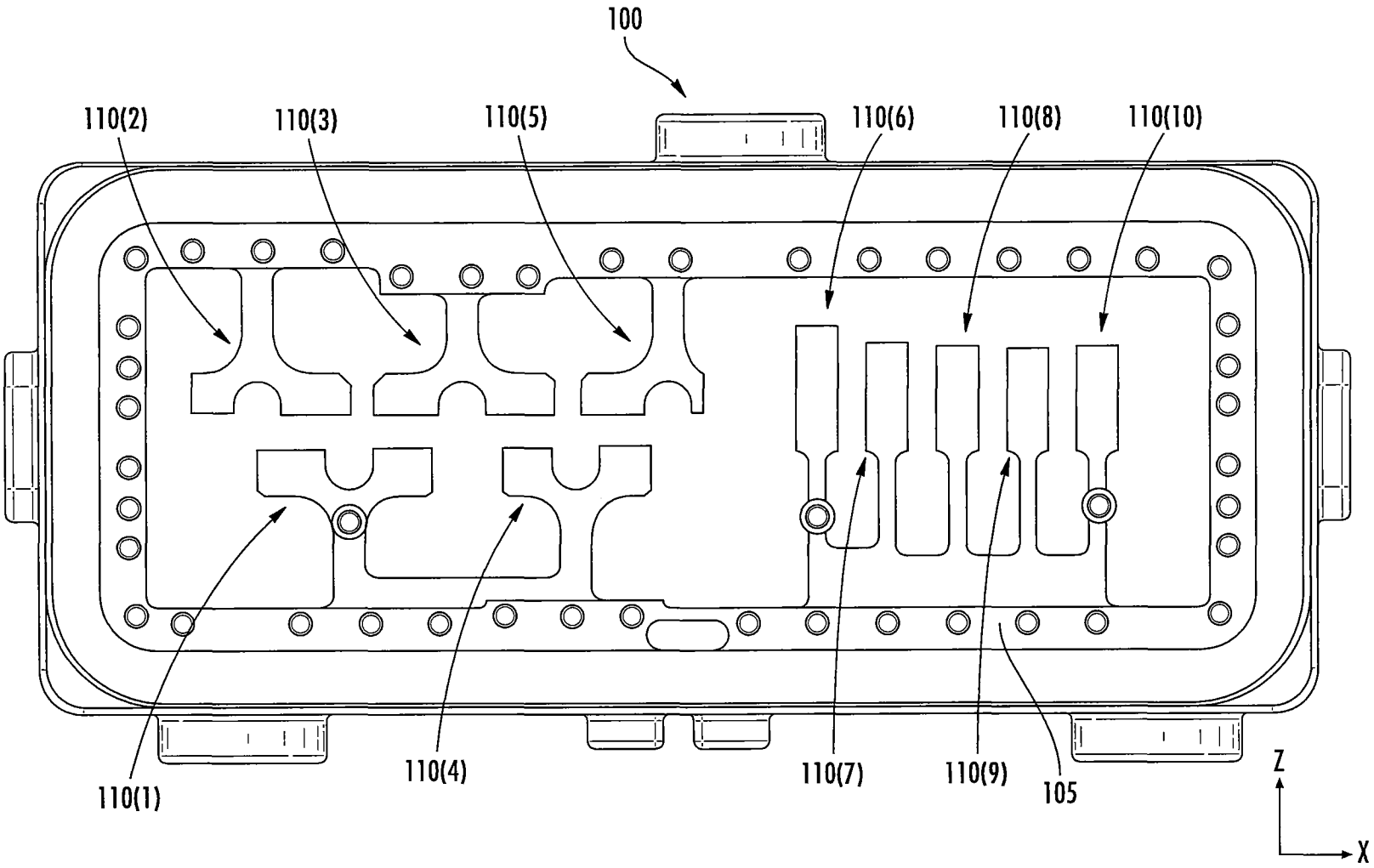
FIG. 1C is a side view of a filter device according to embodiments of the present inventive concepts.

FIG. 1C is a side view of a filter device 100 according to embodiments of the present inventive concepts. As shown in FIG. 1C, the filter device 100 may include a first group of resonators 110(1)-110(5) and a second group of resonators 110(6)-110(10). Though five resonators are shown in each of the two groups, more (i.e., six or more) or fewer (e.g., three or four) resonators may be included in either group. In some embodiments, the resonators 110(1)-110(5) may be high-band resonators of a high-band channel filter of the filter device 100, and the resonators 110(6)-110(10) may be low-band resonators of a low-band channel filter of the filter device 100. For example, the filter device 100 may comprise an RF combiner (diplexer) that includes the high-band resonators 110(1)-110(5) of the high-band channel filter and the low-band resonators 110(6)-110(10) of the low-band channel filter.

The high-band channel filter of the filter device 100 has a stopband that is below the passband. The high band may include frequencies ranging from 1.9 Gigahertz (GHz) to 2.2 GHz, and the low band, which is low relative to the high band, may include frequencies ranging from 1.7-1.9 GHz.

The high-band resonators 110(1)-110(5) of the high-band channel filter and the low-band resonators 110(6)-110(10) of the low-band channel filter may each extend from a housing 105 in the direction Z. For example, the housing 105 may define a rectangular perimeter around the high-band resonators 110(1)-110(5) and the low-band resonators 110(6)-110(10). The housing 105 may be a metal housing, and the high-band resonators 110(1)-110(5) and the low-band resonators 110(6)-110(10) may be shorted to the metal housing. For example, a single machined or die-cast piece may, in some embodiments, comprise the housing 105, the high-band resonators 110(1)-110(5) of the high-band channel filter, and the low-band resonators 110(6)-110(10) of the low-band channel filter. Accordingly, the housing 105, the high-band resonators 110(1)-110(5), and the low-band resonators 110(6)-110(10) may together comprise the same monolithic metal structure.

In some embodiments, the high-band resonators 110(1)-110(5) and the low-band resonators 110(6)-110(10) may be planar resonators that have a substantially uniform thickness in the direction that is into the page of FIG. 1C. For example, the resonators 110 may each be machined from the same planar metal sheet. The surfaces of the resonators 110 that are shown in FIG. 1C may thus be planar surfaces, which may each have a uniform thickness of at least, for example, 5 mm. In particular, a planar surface of at least one of the high-band resonators 110(1)-110(5) may be coplanar with a planar surface of at least one of the low-band resonators 110(6)-110(10) in the X-Z plane that is shown in FIG. 1C.

The direction Z may be perpendicular to the direction X. In some embodiments, the view shown in FIG. 1C may be a side view of the filter device 100, and the direction Z may thus be a vertical direction. Alternatively, the view shown in FIG. 1C may be a top view of the filter device 100, and the vertical direction may be into the page of FIG. 1C. Accordingly, the filter device 100 may be oriented such that the planar surfaces of the resonators 110 shown in FIG. 1C face horizontally outward or, if the filter device 100 is rotated ninety degrees, vertically upward. The direction in which the planar surfaces of the resonators 110 face may be perpendicular to both of the directions X and Z.

Figure 1D:
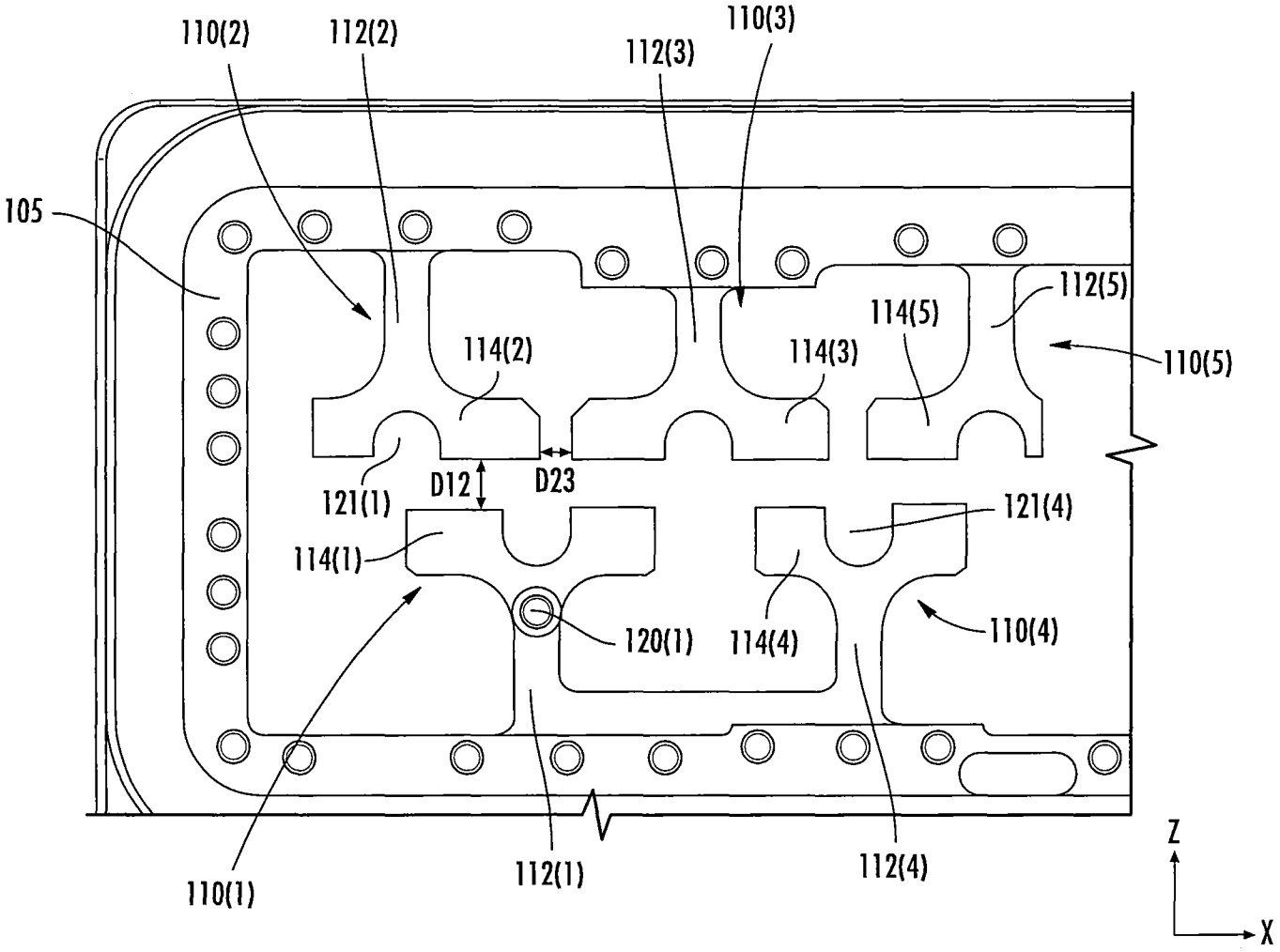
FIG. 1D is an enlarged view of high-band resonators of the filter device of FIG. 1C.

FIG. 1D is an enlarged view of the high-band resonators 110(1)-110(5) of the filter device 100 of FIG. 1C. The high-band resonators 110(1)-110(5) include respective stalks 112(1)-112(5) and respective resonator heads 114(1)-114(5). Rather than being in line with the resonator heads 114(2) and 114(3) in the direction X, the resonator head 114(1) is opposed to (e.g., on an opposite portion of the housing 105 from) the resonator heads 114(2) and 114(3) in the direction Z. Similarly, the resonator head 114(4) is opposed to the resonator heads 114(3) and 114(5) in the direction Z. Accordingly, the resonator head 114(1) is capacitively coupled in the direction Z to the resonator heads 114(2) and 114(3), and vice versa. Similarly, the resonator head 114(4) is capacitively coupled in the direction Z to the resonator heads 114(3) and 114(5), and vice versa.

The resonator head 114(3) is also capacitively coupled to the resonator heads 114(2) and 114(5) in the direction X, and vice versa. The resonator heads 114(1) and 114(4), however, may be sufficiently far apart from each other in the direction X that negligible capacitive coupling will occur with respect to each other.

In some embodiments, electromagnetic couplings between the high-band resonators 110(1)-110(5) may be only negative. The exclusively-negative couplings are the result of capacitive couplings between adjacent and non-adjacent ones of the high-band resonators 110(1)-110(5), together with the absence of inductive coupling, and is due to the shape and topology of the high-band resonators 110(1)-110(5). By having only negative couplings between the high-band resonators 110(1)-110(5), a high-band channel filter having good performance may be provided.

Adjacent ones of the resonator heads 114(1)-114(5) may be spaced apart from each other by a shortest (e.g., minimum) distance of at least 4-6 mm. For example, the resonator heads 114(2) and 114(3) may be spaced apart from each other in the direction X by a distance D23 of at least 4 mm. The distance D23 may narrower (e.g., 4 mm) or wider (e.g., 6 mm) based on the frequencies that are used with the high-band resonators 110(1)-110(5). The resonator heads 114(3) and 114(5) may also be spaced apart from each other in the direction X by at least 4 mm. The resonator heads 114(2) and 114(5), on the other hand, have the resonator head 114(3) therebetween and thus are a non-adjacent pair of resonator heads that are in line with each other in the direction X.

Ones of the resonator heads 114(1)-114(5) that are adjacent in the direction Z may be spaced apart from each other in the direction Z by at least 6 mm. For example, the resonator heads 114(1) and 114(2) may be spaced apart from each other in the direction Z by a distance D12 of at least 6 mm. In some embodiments, the distance D12 may be longer than the distance D23. The resonator heads 114(1) and 114(5), on the other hand, are a non-adjacent pair of resonator heads that are diagonally across from each other. Similarly, the resonator heads 114(2) and 114(4) are a non-adjacent pair of resonator heads that are diagonally across from each other.

As discussed herein with respect to FIG. 1C, the resonators 110 may be planar resonators that have a substantially uniform thickness. Accordingly, the stalks 112 and the resonator heads 114 may have substantially no variation in thickness in a direction that is into the page of FIG. 1D. For example, each of the stalks 112 and each of the resonator heads 114 may have substantially the same thickness in a range of 5-6 mm. Moreover, planar surfaces of the stalks 112 may be coplanar with planar surfaces of the resonator heads 114 in the X-Z plane.

One or more of the high-band resonators 110(1)-110(5) may have a tuning element 120 thereon. For example, a tuning element 120(1) may be on the stalk 112(1) of the resonator 110(1). The tuning element 120(1) may be a metal tuning element or a dielectric tuning element, such as a metal tuning screw or a dielectric tuning screw. Additionally or alternatively, one or more of the resonator heads 114(1)-114(5) may have a cutout region 121 therein for a tuning element 120. As an example, the resonator head 114(4) may include a cutout region 121(4) that is shaped to receive a tuning element 120 that is a metal tuning screw.

Advantages of a dielectric tuning element may include its mechanical strength, as well as its dielectric property. Both a dielectric tuning element and a metal tuning element can change capacitive coupling(s) between the resonators 110. For negative coupling, a metal tuning element makes the coupling weaker with increased insertion depth, whereas a dielectric tuning element makes the coupling stronger with increased insertion depth.

In some embodiments, two or more of the high-band resonators 110(1)-110(5) can overlap each other in the direction that is into the page of FIG. 1D. For example, instead of being spaced apart from each other in the direction Z, the resonator head 114(1) can overlap at least one of the resonator head 114(2) or the resonator head 114(3). This can increase the amount of capacitive coupling. It may be more difficult, however, to cast the resonators 110 as overlapping resonators in one piece. Accordingly, it may be simpler and less expensive to manufacture the resonators 110 as non-overlapping resonators. RF signals of non-overlapping resonators may also be less likely to interfere with each other than RF signals of overlapping resonators. Moreover, casting (e.g., die casting) the housing 105 and each of the resonators 110 together as a single piece, which is easier with non-overlapping resonators, can help to reduce passive intermodulation (PIM) issues. Soldering one or more of the resonators 110 to the housing 105, on the other hand, may undesirably introduce PIM issues.

As shown in FIG. 1D, the high-band resonators 110(1)-110(5) may be Y-shaped resonators. The high-band resonators 110(1)-110(5) are not limited, however, to the Y-shape. For example, the high-band resonators 110(1)-110(5) can be T-shaped or L-shaped resonators that may have respective holes (e.g., cutout regions 121) therein to receive tuning elements 120.

The high-band resonators 110(1)-110(5) may have stalks 112 of different lengths in the direction Z. For example, the stalk 112(3) for the resonator 110(3) may be shorter than the stalks 112(1), 112(2), 112(4), and 112(5) in the direction Z. The shorter stalk 112(3) may help to provide a desired resonant frequency. As another example, the stalks 112(1) and 112(4) may be longer in the direction Z than the stalks 112(2), 112(3), and 112(5). Though using longer stalks 112(1) and 112(4) may introduce small inductive (positive) coupling between the resonators 110(1) and 110(4) in the direction X, this inductive coupling is canceled by negative couplings among the resonators 110(1)-110(5). Small positive coupling(s) may, in some embodiments, exist between an even number (e.g., two or four) of the resonators 110(1)-110(5).

Negative couplings between ones of the resonators 110(1)-110(5) that are on opposite sides of the high-band channel filter in the direction Z, on the other hand, may involve an odd number (e.g., three or five) of the resonators 110(1)-110(5). The odd number may include at least two pairs of opposed ones of the high-band resonators 110(1)-110(5). For example, among the three resonators 110(1)-110(3), the resonators 110(1) and 110(2) provide one pair of opposed resonators, and the resonators 110(1) and 110(3) provide another pair of opposed resonators. Even if positive coupling(s) are present between adjacent stalks 112 of an even number of the high-band resonators 110(1)-110(5), the total positive coupling(s) are smaller than the total negative couplings among the high-band resonators 110(1)-110(5).

Figure 1E:
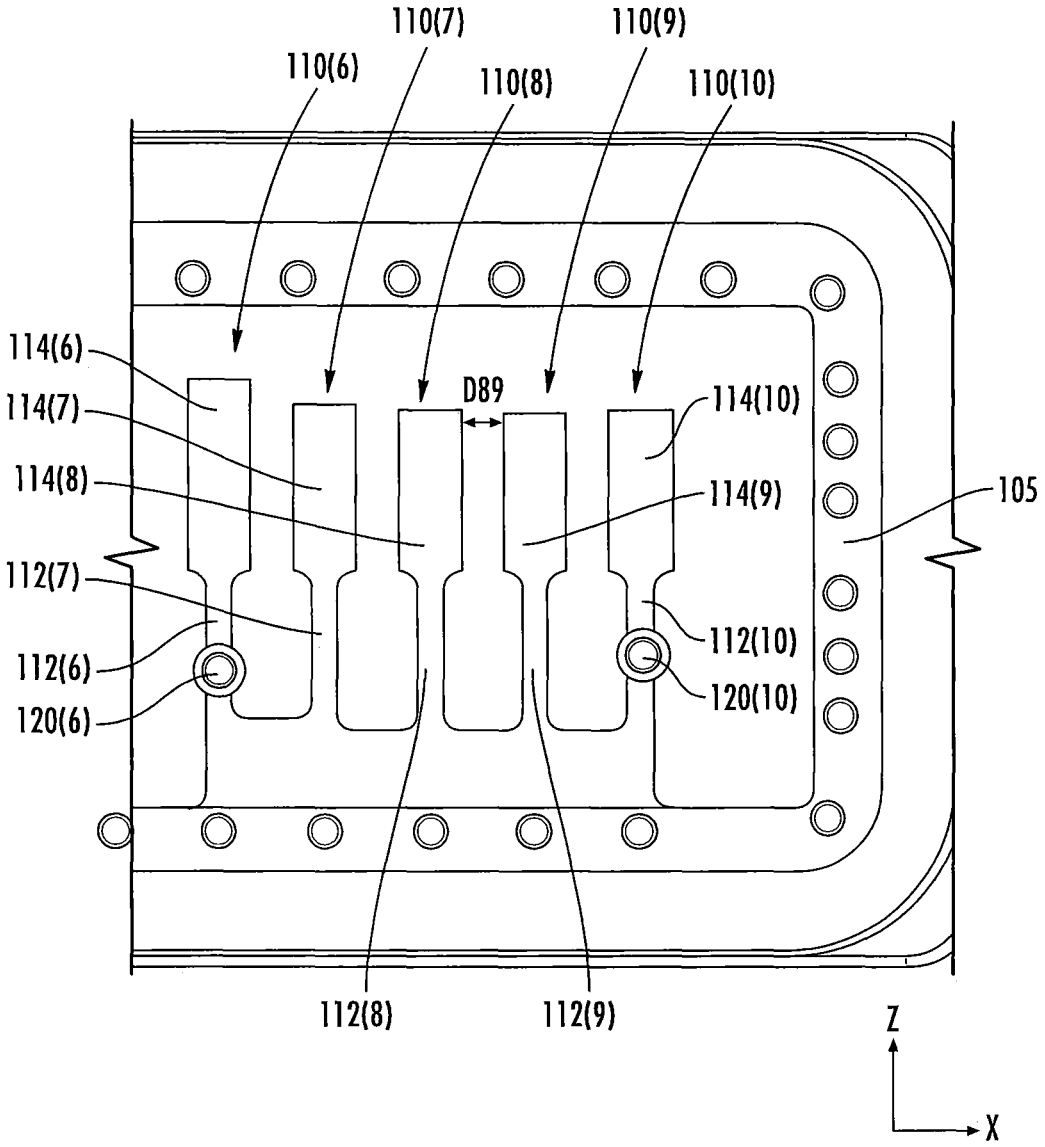
FIG. 1E is an enlarged view of low-band resonators of the filter device of FIG. 1C.

FIG. 1E is an enlarged view of the low-band resonators 110(6)-110(10) of the filter device 100 of FIG. 1C. The low-band resonators 110(6)-110(10) may include respective stalks 112(6)-112(10) and respective resonator heads 114(6)-114(10). As discussed above with respect to FIG. 1C, the resonators 110 may each be planar resonators. The stalks 112(6)-112(10) and resonator heads 114(6)-114(10) may thus be planar. For example, the resonator heads 114(6)-114(10) may be planar rectangular resonator heads.

Adjacent ones of the resonator heads 114(1)-114(5) (FIG. 1D) of the high-band channel filter may be spaced farther apart from each other in the direction X than adjacent ones of the resonator heads 114(6)-114(10) of the low-band channel filter. For example, a distance D89 in the direction X between the resonator head 114(8) and the resonator head 114(9) may be 3 mm or narrower, whereas the distance D23 in FIG. 1D may be at least 4 mm. Also, adjacent ones of the stalks 112(1)-112(5) (FIG. 1D) of the high-band channel filter may be spaced farther apart from each other in the direction X than adjacent ones of the stalks 112(6)-112(10) of the low-band channel filter. The wider spacing between the high-band resonators 110(1)-110(5) may help to reduce/prevent inductive coupling(s) between the high-band resonators 110(1)-110(5), and may further help to provide mechanical tolerances for which the tuning element(s) 120 can compensate.

One or more of the low-band resonators 110(6)-110(10) may have a tuning element 120 thereon. For example, the stalk 112(6) may have a tuning element 120(6) thereon, and the stalk 112(10) may have a tuning element 120(10) thereon. The tuning element 120(10) may be, for example, a metal tuning screw or a dielectric tuning screw. Moreover, one or more of the high-band resonators 110(1)-110(5) (FIG. 1D) may be shorter than one or more of the low-band resonators 110(6)-110(10) in the direction Z.

The low-band channel filter shown in FIG. 1E is an in-line (i.e., in-line only) resonator filter in which all of the low-band resonators 110(6)-110(10) are in a line in the direction X. The high-band channel filter shown in FIG. 1D, by comparison, is provided by the high-band resonators 110(1)-110(5), which include opposed resonators that are not all in the same line in the direction X. In particular, FIG. 1D shows that the open end (i.e., the resonator head 114(1)) of the resonator 110(1) is opposite the open ends (i.e., the resonator heads 114(2) and 114(3)) of the resonators 110(2) and 110(3), and that the open end of the resonator 110(4) is opposite the open ends of the resonators 110(3) and 110(5).

In some embodiments, the resonators 110(1) and 110(4) may be in a first line with each other in the direction X, and the resonators 110(2), 110(3), and 110(5) may be in a second line with each other in the direction X. The high-band channel filter may thus comprise multiple sets of oppositely-facing in-line resonators, with only (or almost only) negative couplings between the different sets. For example, a first set may include the resonators 110(1) and 110(2)/110(3), and a second set may include the resonators 110(4) and 110(5)/110(3). The opposed, rather than only in-line, topology of the high-band channel filter can help to provide spacing among the high-band resonators 110(1)-110(5) that reduces/prevents positive coupling and that provides mechanical tolerances for which the tuning element(s) 120 can compensate.

The topology of the low-band channel filter shown in FIG. 1E may be suitable for lower frequencies, and the different topology of the high-band channel filter shown in FIG. 1D may be suitable for higher frequencies. If the resonators 110(1)-110(5) were instead replaced by the resonators 110(6)-110(10), then the mechanical tolerances of the resonators 110(6)-110(10) as high-band resonators might be too large to be compensated by tuning elements thereon and/or therebetween. Accordingly, the tuning element(s) 120 might not be able to tune the high-band channel filter. The tighter spacing of the resonators 110(6)-110(10) would also undesirably result in positive couplings. Moreover, for the low-band channel filter, it may be more efficient to use the topology shown in FIG. 1E than the topology shown in FIG. 1D. Using the same one of the two topologies for both lower frequencies and higher frequencies thus may result in lower performance by the filter device 100 than using the combination of the two topologies as shown in FIG. 1C.

Figure 2:
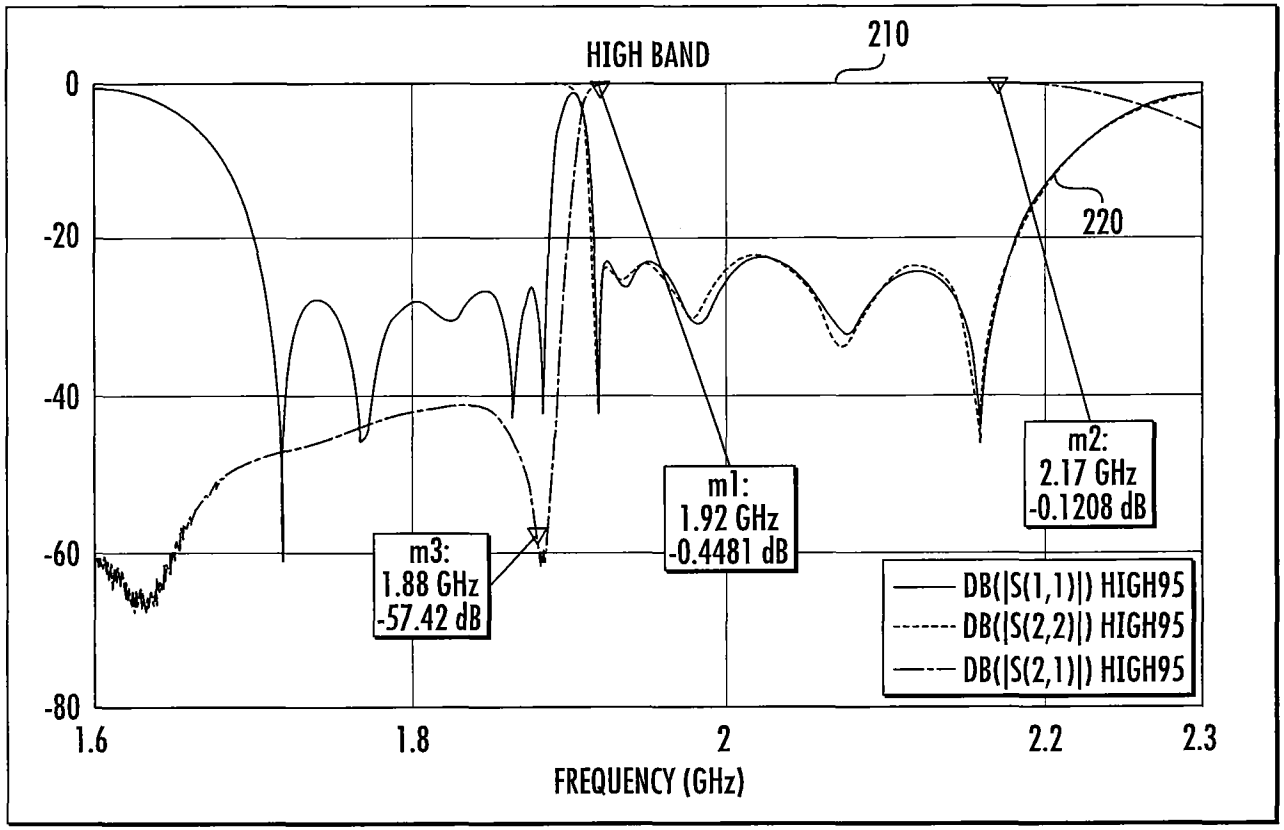
FIG. 2 is a graph of a response of a filter device according to embodiments of the present inventive concepts.

FIG. 2 is a graph of a response of a filter device 100 according to embodiments of the present inventive concepts. As shown in FIG. 2, a transmission characteristic 210 of the filter device 100 is close to 0 decibels (dB) for high-band frequencies, thus indicating that substantially all power is transmitted. At about 1.9 GHz, a transmission zero appears in the response, so that the filter passes essentially none of the RF energy at frequencies below 1.9 GHz. Also shown in FIG. 2 is reflected power (return loss) 220 of the filter device 100. In the passband, it may be desirable to have as little reflection as possible. The filter device 100, by incorporating the high-band channel filter that is shown in FIG. 1D, can achieve good performance both in terms of the transmission characteristic 210 and the reflected power (return loss) 220, as demonstrated in FIG. 2.

In some embodiments, the filter device 100 may provide a compact filter for small cell applications, such as small cell base stations, which are discussed in U.S. Patent Application No. 62/722,416, the entire disclosure of which is incorporated herein by reference.

The topology and shape of the resonators 110 of the filter device 100 according to embodiments of the present inventive concepts may provide a number of advantages. These advantages include improved high-band channel filter performance due to arranging and shaping the high-band resonators 110(1)-110(5) differently from the low-band resonators 110(6)-110(10). In some embodiments, the arrangement and shape of the high-band resonators 110(1)-110(5) can ensure that only negative couplings are used throughout a high-band channel filter that is provided by the high-band resonators 110(1)-110(5). This can achieve a desirable/optimal high-band channel response with an acceptable compromise between size, mechanical complexity, stopband rejection, and insertion losses. Also, because the smallest distance between open ends of the high-band resonators 110(1)-110(5) may, in some embodiments, be greater than 4 mm, the high-band channel filter can be more robust against mechanical tolerances.

Rather than duplicating the topology/shape of the high-band channel filter for a low-band channel filter, the low-band channel filter may more efficiently achieve suitable performance in low-band frequencies by using a different topology/shape. For example, the low-band resonators 110(6)-110(10) that provide the low-band channel filter can achieve suitable performance in low-band frequencies with a simpler and more compact topology/shape.

In some embodiments, PIM issues in the filter device 100 can be advantageously reduced by manufacturing the low-band resonators 110(6)-110(10), the high-band resonators 110(1)-110(5), and the housing 105 together as a single metal piece. Moreover, some embodiments may advantageously use one or more dielectric tuning elements 120 to control capacitive coupling(s) between the resonators 110.

Figure 3:
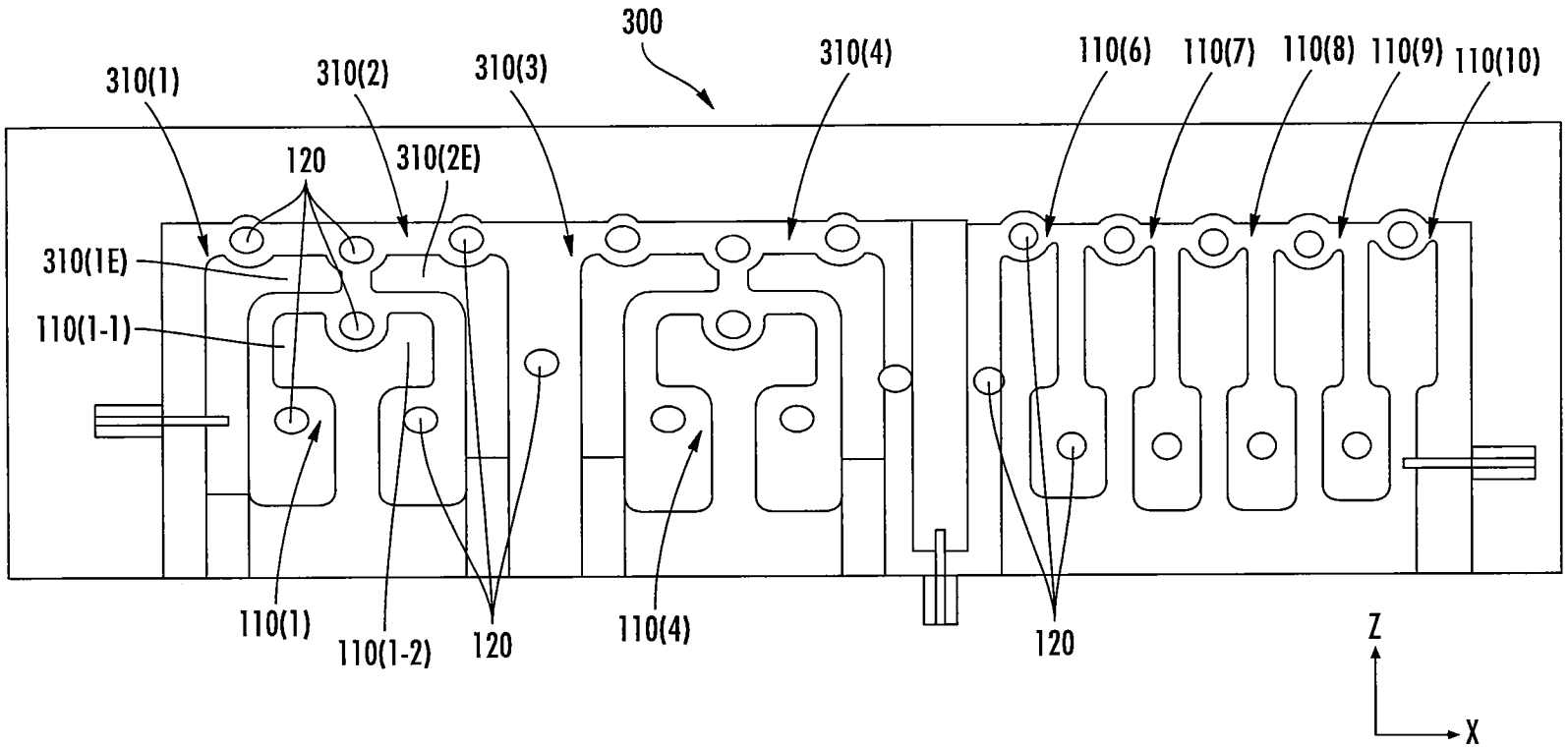
FIG. 3 is a side view of a filter device according to embodiments of the present inventive concepts.

FIG. 3 is a side view of a filter device 300 according to embodiments of the present inventive concepts. The filter device 300 may include the low-band resonators 110(6)-110(10) of the filter device 100, as well as one or more of the high-band resonators 110(1)-110(5). For example, FIG. 3 shows that the high-band resonators 110(1) and 110(4) are included in the filter device 300. In addition to the high-band resonators 110(1) and 110(4), a high-band channel filter of the filter device 300 includes high-band resonators 310(1)-310(4). Each of the high-band resonators 110(1) and 110(4) of the high-band channel filter may be a T-shaped or Y-shaped resonator and may be in a group with a pair of the high-band resonators 310(1)-310(4) of the high-band channel filter.

As an example, the high-band resonators 310(1) and 310(2) may be a first pair of L-shaped resonators. The high-band resonator 110(1) extends between, and is capacitively coupled in the direction Z to, each of the high-band resonators 310(1) and 310(2). Similarly, the high-band resonators 310(3) and 310(4) may be a second pair of L-shaped resonators, and the high-band resonator 110(4) extends between, and is capacitively coupled to, each of the high-band resonators 310(3) and 310(4). Accordingly, the high-band resonators 310(1)-310(4) and the high-band resonators

110(1) and 110(4) may be in a single line (rather than two lines) with each other in the direction X, and may have only (or almost only) negative couplings with each other. Moreover, the filter device 300 may include one or more tuning elements 120, which may be tuning screws.

The filter device 300 may thus include a high-band filter that includes (e.g., only includes) in-line high-band resonators 110 and 310, which are in a single line in the direction X. For example, the high-band filter may include the high-band resonator 310(1), which includes a portion 310(1E) that extends in the direction X over a portion 110(1-1) of the high-band resonator 110(1), such that the portion 310(1E) overlaps, and is capacitively coupled to, the portion 110(1-1) in the direction Z. In some embodiments, the filter device 300 may also include a low-band filter that includes only in-line low-band resonators, such as the low-band resonators 110(6)-110(10).

Moreover, the high-band filter may include the high-band resonator 310(2), which may include a portion 310(2E) that extends in the direction X over a portion 110(1-2) of the high-band resonator 110(1), such that the portion 310(2E) overlaps, and is capacitively coupled to, the portion 110(1-2) in the direction Z. The portion 110(1-1) and the portion 110(1-2) may be left and right ends, respectively, of the resonator head 114(1) that is shown in FIG. 1D. A tuning element 120 may, in some embodiments, be between the portion 310(1E) and the portion 310(2E). For example, the portion 310(1E) and the portion 310(2E) may each include a cutout region that accommodates the tuning element 120. Additionally or alternatively, a tuning element 120 may be between a stalk of the high-band resonator 310(1) and a stalk of the high-band resonator 110(1).

Figure 4:
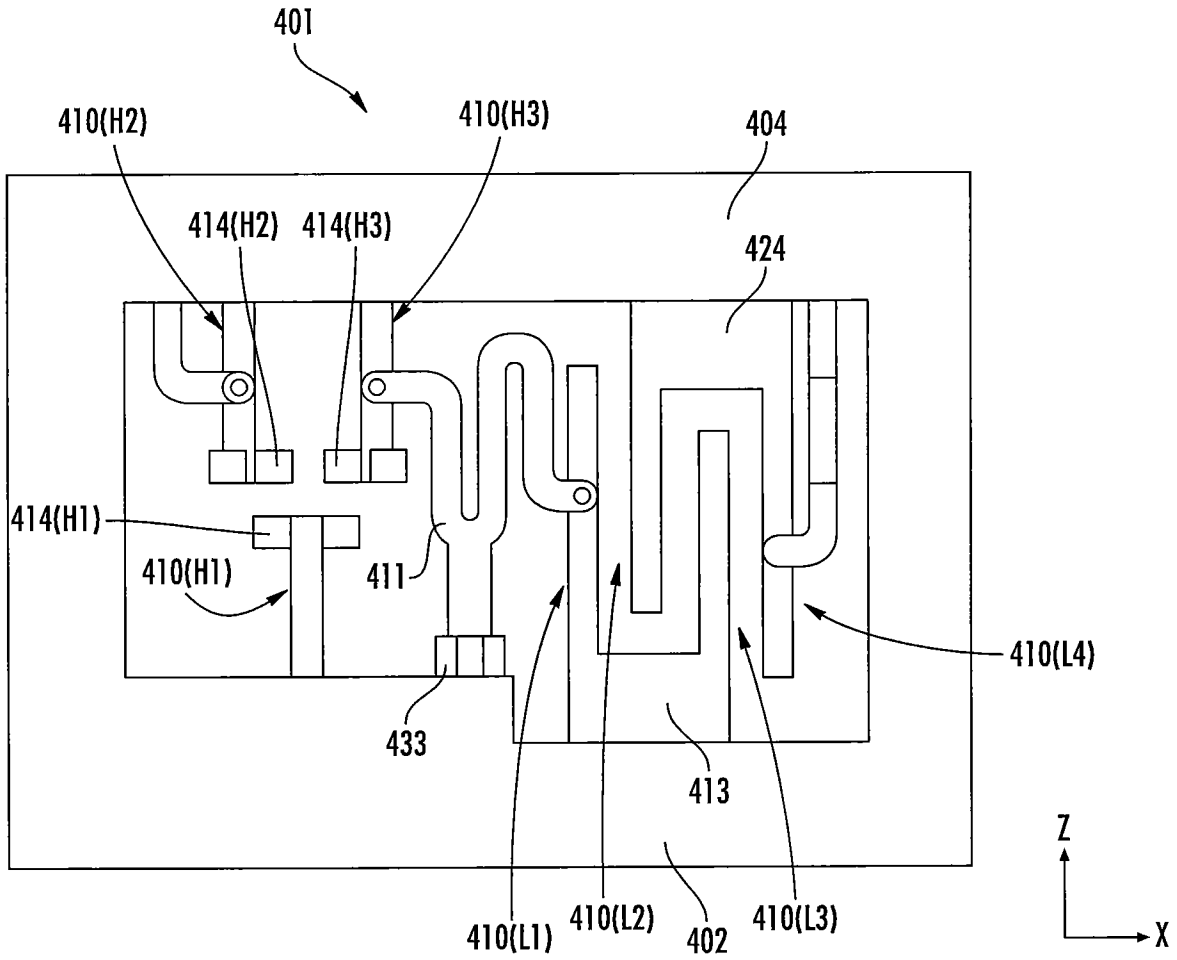
FIG. 4 is a side view of a filter device according to embodiments of the present inventive concepts.

FIG. 4 is a side view of a filter device 401 according to embodiments of the present inventive concepts. The filter device 401 may include I-shaped (or rectangle-shaped) low-band resonators 410(L1)-410(L4), and may further include high-band resonators 410(H1)-410(H3). The low-band resonators 410(L1)-410(L4) may have negative couplings and positive cross-couplings with each other in a double-line configuration. For example, the low-band resonators 410(L2) and 410(L4) and may extend in the direction Z from a top of the filter device 401, and may combine with the low-band resonators 410(L1) and 410(L3), which extend in the direction Z from a bottom of the filter device 401, to provide an interdigital low-band channel filter whose main interdigital coupling(s) may be negative. The meander-like shape in FIG. 4 is a T-junction 411 at a common port 433 of the low-band channel filter and the high-band channel filter. The T-junction 411 may, in some embodiments, be an ohmic connection between the low-band channel filter and the high-band channel filter.

As an example, the filter device 401 may include a low-band filter, a high-band filter, and an ohmic connection 411 that is between the low-band filter and the high-band filter and that electrically couples the low-band filter and the high-band filter to the common port 433 of the filter device 401. In some embodiments, however, the ohmic connection 411 may be omitted.

The low-band filter of the filter device 401 may include interdigitating low-band resonators 410(L1)-410(L4), adjacent ones of which may be coaxial resonators that are negatively coupled to each other. Additionally or alternatively, the high-band filter of the filter device 401 may include the high-band resonator 410(H1), which may have a resonator head 414(H1) that is opposite, and capacitively coupled to, a resonator head 414(H2) of the high-band resonator 410(H2) in the direction Z. Moreover, the high-band filter may include the high-band resonator 410(H3), which may have a resonator head 414(H3) that is opposite, and capacitively coupled to, the resonator head 414(H1) in the direction Z. The high-band resonators 410(H2) and 410(H3) may be in line with each other in the direction X.

In some embodiments, the filter device 401 may include an ohmic connection 413 that electrically couples the low-band resonators 410(L1) and 410(L3) to each other. Similarly, the filter device 401 may include an ohmic connection 424 that electrically couples the low-band resonators 410 (L2) and 410(L4) to each other. The ohmic connection 413 may be between a bottom ground plane 402 of the filter device 401 and the low-band resonators 410(L1) and 410 (L3), and the ohmic connection 424 may be between a top ground plane 404 of the filter device 401 and the low-band resonators 410(L2) and 410(L4). Positive cross-coupling between the low-band resonators 410(L1) and 410(L3) may be realized through the ohmic connection 413, and positive cross-coupling between the low-band resonators 410(L2) and 410(L4) may be realized through the ohmic connection 424. This, in turn, may realize a transmission zero above the passband, thus providing a good low-band filter.

Figure 5:
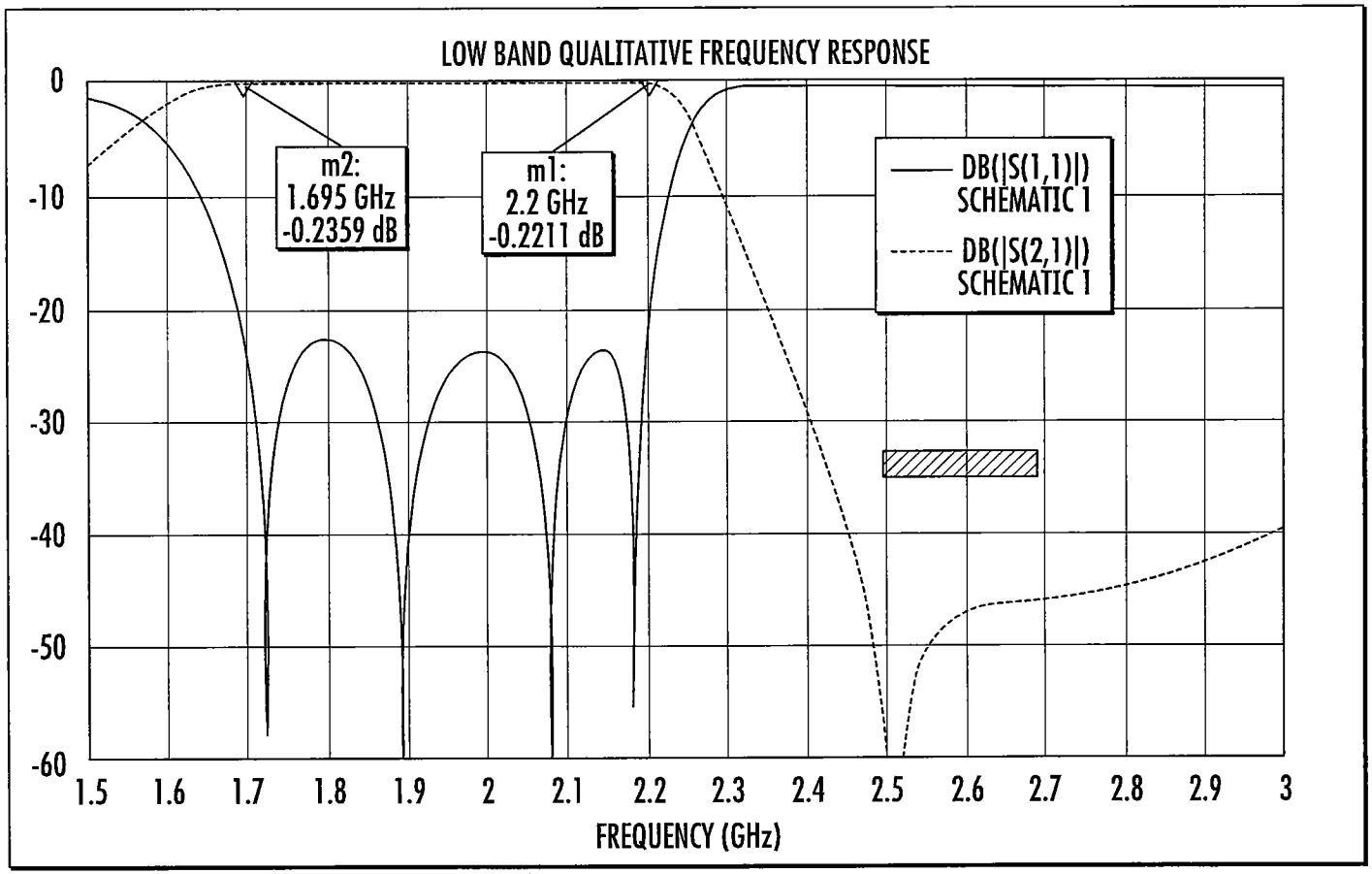
FIG. 5 is a graph of a response of a filter device according to embodiments of the present inventive concepts.

FIG. 5 is a graph of a response of a filter device 401 according to embodiments of the present inventive concepts. As shown in FIG. 5, positive cross-couplings in a low-band filter of the filter device 401 may result in a transmission zero above the passband, thus providing good low-band filtering.

The filter devices 100, 300, 401 according to embodiments of the present inventive concepts can be implemented using (a) one layer of resonators or (b) two layers of resonators. For example, any of the filter devices 100, 300, 401 can be implemented using a double-sided resonator structure, which is described in U.S. Patent Application No. 62/796,752, filed on Jan. 25, 2019 ("the '752 application"), the entire disclosure of which is incorporated herein by reference. Accordingly, one or more of the filter devices 100, 300, 401 of the present inventive concepts can be implemented using a double-sided PCB 110 of the '752 application that includes first and second resonator layers 110RL and 110RL'. Alternatively, the first and second resonator layers 110RL and 110RL' may be on a non-PCB substrate 110SUB, such as a dielectric substrate. The first and second resonator layers 110RL and 110RL' may each comprise a high-band and/or low-band resonator layer.

As an example, referring to FIGS. 1C-1E of the present application, a first resonator layer may comprise the resonators 110(1)-110(5) and/or the resonators 110(6)-110(10) on a first side of a substrate, such as a PCB (or non-PCB) substrate 110SUB of the '752 application. Accordingly, a first resonator layer 110RL that is described in the '752 application (e.g., as shown in FIG. 1C thereof) may include the resonators 110(1)-110(5) and/or the resonators 110(6)-110(10) of the present inventive concepts. Also, a second resonator layer 110RL' that is described in the '752 application may be on an opposite, second side of the substrate and may be electrically coupled to the first resonator layer 110RL by metal that extends from the first side of the substrate to the second side of the substrate.

The metal that electrically couples the first and second resonator layers 110RL and 110RL' to each other may comprise one or more metallized vias 110V and/or metal plating 110EP, as described in the '752 application. For example, the metal plating 110EP may be on a substrate sidewall 110SW exposed by an opening 603, as shown in FIG. 7C of the '752 application, between adjacent ones of the resonators 110(1)-110(5) and/or adjacent ones of the resonators 110(6)-110(10) of the present inventive concepts.

In some embodiments, the resonator shapes in the second resonator layer 110RL' may correspond to (e.g., mirror) the resonator shapes in the first resonator layer 110RL. For example, the resonator 110(1) in the first resonator layer 110RL may vertically overlap a resonator in the second resonator layer 110RL' that has the same size and shape as the resonator 110(1). The resonators 110(1)-110(10) may, in some embodiments, completely vertically overlap corresponding resonators in the second resonator layer 110RL'. Alternatively, the overlap between the first resonator layer 110RL and the second resonator layer 110RL' may be partial, as shown in FIG. 5D of the '752 application.

As another example, referring to FIG. 3 of the present application, a first resonator layer 110RL that is described in the '752 application may include the resonators 310(1)-310(4), 110(1), 110(4), and/or 110(6)-110(10) on a first side of a substrate. Moreover, a second resonator layer 110RL' may be on an opposite, second side of the substrate and may be electrically coupled to the first resonator layer 110RL by metallized via(s) 110V and/or metal plating 110EP extending from the first side of the substrate to the second side of the substrate.

Similarly, referring to FIG. 4 of the present application, a first resonator layer 110RL that is described in the '752 application may include the resonators 410(L1)-410(L4) and/or 410(H1)-410(H3) on a first side of a substrate, and a second resonator layer 110RL' may be on an opposite, second side of the substrate and may be electrically coupled to the first resonator layer 110RL by metallized via(s) 110V and/or metal plating 110EP extending from the first side of the substrate to the second side of the substrate.

The present inventive concepts have been described above with reference to the accompanying drawings. The present inventive concepts are not limited to the illustrated embodiments. Rather, these embodiments are intended to fully and completely disclose the present inventive concepts to those skilled in this art. In the drawings, like numbers refer to like elements throughout. Thicknesses and dimensions of some components may be exaggerated for clarity.

Spatially relative terms, such as "under," "below," "lower," "over," "upper," "top," "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the example term "under" can encompass both an orientation of over and under. The device may be otherwise oriented (rotated 90 degrees or at other orientations) and the spatially relative descriptors used herein interpreted accordingly.

Herein, the terms "attached," "connected," "interconnected," "contacting," "mounted," and the like can mean either direct or indirect attachment or contact between elements, unless stated otherwise.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the present inventive concepts. As used herein, the singular forms "a," "an," and "the" are intended to include the plural forms as well, unless the context clearly indicates otherwise. It will be further understood that the terms "comprises," "comprising," "includes," and/or "including" when used in this specification, specify the presence of stated features, operations, elements, and/or components, but do not preclude the presence or addition of one or more other features, operations, elements, components, and/or groups thereof.

That which is claimed is:

1. A filter device, comprising:

a plurality of low-band resonators; and a plurality of high-band resonators, wherein a first and a second of the plurality of high-band resonators each extend in a first direction, and wherein a first resonator head of the first of the plurality of high-band resonators is capacitively coupled to a second resonator head of the second of the plurality of high-band resonators, and wherein the first resonator head oppositely faces the second resonator head in the first direction.

2. The filter device of claim 1, further comprising a single machined or die-cast piece that comprises the plurality of high-band resonators.

3. The filter device of claim 2, wherein the single machined or die-cast piece further comprises:

the plurality of low-band resonators; and a housing from which the plurality of high-band resonators and the plurality of low-band resonators extend, and wherein a shortest distance between the first and second resonator heads is at least 4-6 millimeters (mm).

4. The filter device of claim 1, wherein each of at least a subset of the plurality of high-band resonators includes a tuning element thereon.

5. A filter device comprising:

a plurality of low-band resonators; and a plurality of high-band resonators, wherein adjacent resonator heads of the plurality of high-band resonators are spaced farther apart from each other than adjacent resonator heads of the plurality of low-band resonators are spaced apart from each other, and wherein adjacent stalks of the plurality of high-band resonators are spaced farther apart from each other than adjacent stalks of the plurality of low-band resonators are spaced apart from each other.

6. The filter device of claim 5, wherein the plurality of high-band resonators comprises a plurality of planar Y-shaped resonators, respectively.

7. The filter device of claim 5, wherein the adjacent resonator heads of the plurality of low-band resonators comprise planar rectangular resonator heads, respectively.

8. The filter device of claim 5, wherein electromagnetic couplings between at least three of the plurality of high-band resonators comprise only negative couplings.

9. The filter device of claim 5, wherein the at least three of the plurality of high-band resonators comprise at least two pairs of opposed ones of the plurality of high-band resonators.

10. The filter device of claim 5, wherein positive coupling between the adjacent stalks of an even number of the plurality of high-band resonators is smaller than negative couplings between the adjacent stalks.

11. The filter device of claim 5, wherein a first and a second of the plurality of high-band resonators each extend in a first direction, and wherein a first resonator head of the first of the plurality of high-band resonators is capacitively coupled to a second resonator head of the second of the plurality of high-band resonators, and wherein the first resonator head oppositely faces the second resonator head in the first direction.

12. A filter device, comprising:

a low-band filter;

a high-band filter comprising high-band resonators, wherein a first of the high-band resonators extends from a first sidewall and a second of the high-band resonators extends from an opposed second sidewall, and wherein heads of the first and second high-band resonators are configured to capacitively couple; and a first ohmic connection that is between the low-band filter and the high-band filter and that electrically couples the low-band filter and the high-band filter to a common port of the filter device.

13. The filter device of claim 12, wherein the high-band filter comprises a first high-band resonator that is opposite, and capacitively coupled to, a second high-band resonator of the high-band filter.

14. The filter device of claim 13, wherein the high-band filter comprises a third high-band resonator that is opposite, and capacitively coupled to, the first high-band resonator, and wherein the second and third high-band resonators are in line with each other.

15. The filter device of claim 12, wherein the low-band filter comprises interdigitating low-band resonators.

16. The filter device of claim 15, wherein a first and a second of the low-band resonators are electrically coupled to each other by a second ohmic connection.

* * * * *